United States Patent [19]

Walker et al.

[11] Patent Number: 4,647,354

[45] Date of Patent: Mar. 3, 1987

[54] PROTECTORS FOR PRINTING CYLINDER SHAFTS OR THE LIKE

[75] Inventors: Ronald Walker, Lee's Summit; Donald A. Shafer, Kansas City; Clarence Yeo, Raytown, all of Mo.

[73] Assignee: Hallmark Cards, Inc., Kansas City, Mo.

[21] Appl. No.: 740,194

[22] Filed: May 31, 1985

[51] Int. Cl.[4] ..... C25D 17/00

[52] U.S. Cl. ..... 204/212

[58] Field of Search ..... 204/212, 215, 218

[56] References Cited

U.S. PATENT DOCUMENTS 3,462,357 8/1969 Karlquist ..... 204/212
3,660,265 5/1972 Kangas ..... 204/212
3,664,944 5/1972 Buckley ..... 204/212
4,519,887 5/1985 Shigeta ..... 204/212

*Primary Examiner*—T. M. Tufariello
*Attorney, Agent, or Firm*—Neuman, Williams, Anderson & Olson

[57] ABSTRACT

This invention relates to devices for protecting the ends of printing cylinder shafts or the like during electroplating operations, and more particularly, to devices which provide a reliable sealed enclosure operating to protect the shafts and which are readily assembled on the shafts and disassembled therefrom. The devices accommodate shafts of various lengths. They are relatively simple in construction, are readily and economically manufactured, and are easily maintained. Costs of labor and material are reduced to reduce operating costs.

16 Claims, 5 Drawing Figures

PROTECTORS FOR PRINTING CYLINDER SHAFTS OR THE LIKE

BACKGROUND OF THE INVENTION

Printing cylinders are prepared by plating a layer of metal, such as copper, on the surface of the cylinder, for subsequent etching or engraving operations and for printing operations therewith. Conventionally, the printing cylinders have projecting shaft portions which, in the plating operation, are engaged with support hub units on the outside of side walls of a plating tank. At least one hub unit is connected to a drive source and a slip ring unit is associated with at least one hub unit for connection to one terminal of a current supply source. In such apparatus, the shafts and the ends of the cylinders have been protected from corrosion by winding a tape therearound prior to the plating operation. With this taping process, results have been obtained which have heretofore seemed to have been reasonably satisfactory and, so far as is known, no efforts have been directed by others toward improvements of the process.

SUMMARY OF THE INVENTION

This invention was evolved with the general object of improving the protection of printing cylinder shafts or the like during plating operations.

A specific object of the invention is to provide protective apparatus which can be readily, and quickly installed and which can also be readily and quickly removed after a plating operation.

Another specific object of the invention is to provide protective apparatus which is readily and economically manufactured.

A further specific object of the invention is to provide protective apparatus which will readily accommodate shafts of varying lengths.

Still another object is to provide protective apparatus such that maintenance and operating costs are minimized.

Important aspects of the invention relate to the recognition of problems with the taping process heretofore used in protecting cylinder shafts. It is found that the taping process is quite expensive, both from a standpoint of the time involved and installing the tape and also with regard to the cost of the tape itself, a special relatively expensive tape being required. It has also been found to be potentially dangerous due to the fact that the cylinder is rotated during application of the tape, with a possibility of contact between the highly corrosive bath and the person installing the tape.

Another problem is that the taping method tends to be unreliable, particularly with respect to any openings which may inadvertently be provided, inviting corrosion of the surface of the shaft and also inviting iron contamination of the plating bath.

Still another problem was found in connection with installing protective shields on the ends of the cylinder, such shields being constructed in accordance with our copending application Ser. No. 734,563, filed May 15, 1985. It was found to be difficult with the prior method to obtain secure attachment of the shields with unreliable operation as a result.

In accordance with this invention, a pair of protective devices are provided which are arranged to be assembled on the outside of the shafts between the ends of the cylinder and the support hub units prior to a plating operation and also arranged to be removed after a plating operation for subsequent reuse. Each of the protective devices comprises a sleeve section disposed between a cylinder hub section and an engagement section. The cylinder hub section is sealingly engaged with one end of the cylinder. The engagement section is disposed adjacent a support hub unit. Each of the three sections is of a corrosion resistant material and together they cooperate to provide a protective sealed enclosure for the associated shaft.

A feature of the invention is that the sleeve section is a tubular member which is preferably of stainless steel to obtain high strength but with a minimal outside diameter so that the lower end of the opening through the tank walls can be as high as possible and so that the level of liquid can be high for efficient plating. The cylinder hub section and preferably also the engagement section are of an insulating material such as PVC and the stainless steel tubular member is so supported therefrom as to be insulated from the shaft.

In accordance with a specific feature, the engagement section of at least one of the devices is axially adjustable in length. Preferably, it includes an internally threaded nut member which is threaded onto an externally threaded ring at the outer end of the sleeve section and which is rotatable relative thereto to exert axial forces such as to obtain reliable seals. With a construction as shown in the drawing and hereinafter described, a highly reliable seal is readily and quickly obtained with a hand assembly and without requiring any tools.

In accordance with another specific feature, the sleeve section includes a tubular member having an outer end portion which is inserted in a socket of the engagement section. Preferably, the outer end of the tubular member engages an internal annular shoulder of the aforementioned externally threaded ring and inner engagement means are provided such as to lock the ring against rotation relative to the member. At the inner end, the tubular member is telescopically engaged with a sleeve portion of the cylinder hub section, being preferably inserted within a sleeve of the cylinder hub portion, with engagement means being provided to lock the tubular member against rotation relative to the sleeve.

A number of tubular members of various different lengths may be provided to accommodate printing cylinder shafts of varying lengths, with fine adjustments being possible through the use of the adjustable engagement section.

Further features relate to the construction of the cylinder hub section. The aforementioned sleeve, which defines a socket receiving the inner end of the tubular member, is preferably of a stainless steel material and its inner end is secured within the central opening of a pressure plate of annular form which is sealingly engaged with a separate sealing member, also of annular form, the sealing member being engaged with the end of the printing cylinder.

In accordance with a further important feature, a shield is provided for shielding the end of the cylinder, as disclosed in our copending application, Ser. No. 734,563, filed May 15, 1985, the shield being of dish-like configuration and having an inner portion clamped between the pressure plate and the face seal which abuts the end of the cylinder. This arrangement is highly advantageous in obtaining accurate and reliable positioning of the shield, to obtain the advantages as set forth in our aforesaid prior copending application.

This invention contemplates other objects, features and advantages which will become more fully apparent from the following detailed description, taken in conjunction with the accompanying drawings.

DESCRIPTION OF A PREFERRED EMBODIMENT

Figure 1:
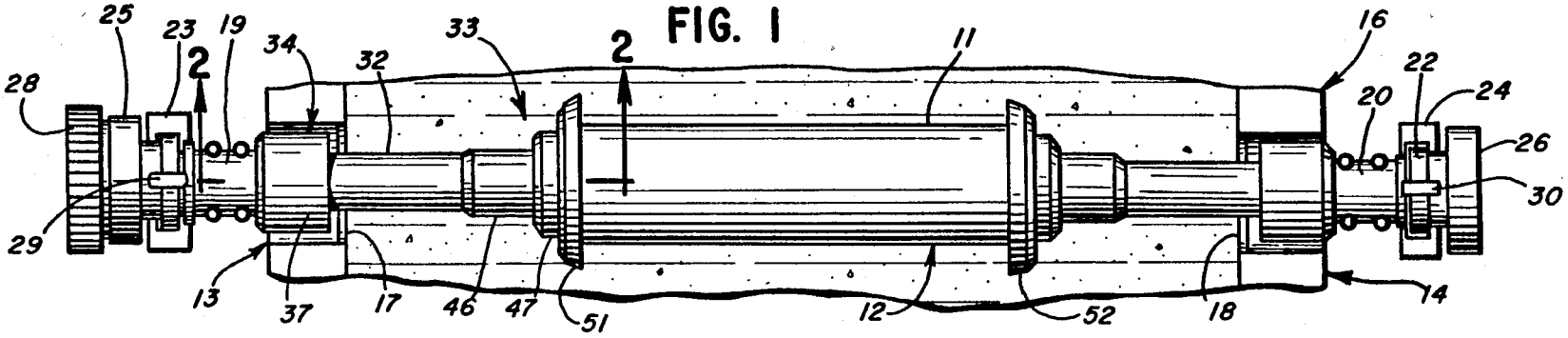
FIG. 1 is a top plan view of a portion of a plating system, showing a printing cylinder, portions of a tank and support, drive and slip-ring elements, also showing a pair of protective devices constructed in accordance with the invention.

Reference numeral 10 generally designates electroplating apparatus for electrodeposition of a layer on the cylindrical surface 11 of a metal cylinder 12, using a pair of protective devices 13 and 14 which are constructed in accordance with the principles of the invention.

The cylinder 12 is rotated about a horizontal axis while a lower portion thereof is immersed in a plating bath which is contained within a tank 16 having a pair of opposed side walls 17 and 18. Anode structures, not shown, are provided in the bath along the opposite sides of the cylinder 12 and are connected to the positive terminal of a current supply, also not shown, having a negative terminal connected to the cylinder 12. By way of example, the anode structures may include copper chips in bags of a titanium mesh which are hung on support bars parallel to the axis of the cylinder 12.

A pair of shafts extend from the ends of the cylinder 12 and within the protective devices 13 and 14, the ends of the shafts being secured in hub units 19 and 20 which have clamping bolts associated therewith for connection to and disconnection from the shaft ends. Hub units 19 and 20 have portions which are journalled for rotation in bearing units 21 and 22 held in supports 23 and 24. To connect to the negative terminal of a current supply, commutating or slip rings 25 and 26 are integrally connected to the hub units 23 and 24 and, for rotating the cylinder 12, a gear 28 is connected to the hub unit 19, gear 28 being meshed with a motor-driven gear, not shown.

Rings 29 and 30 are provided on the upper ends of the bearing units 21 and 22 for engagement with lift hooks. Rings 29 and 30 are used after completion of a plating operation to permit the entire assembly to be lifted and moved to a position away from the tank 16, for disconnection from the hub units 19 and 20 and for removal of the protective devices 13 and 14 of the invention. Then the devices 13 and 14 may be assembled on the shafts of an unplated cylinder and after clamping the hub units 19 and 20 thereto, the assembly is placed back in a position as shown, for plating of the unplated cylinder.

Figure 2:
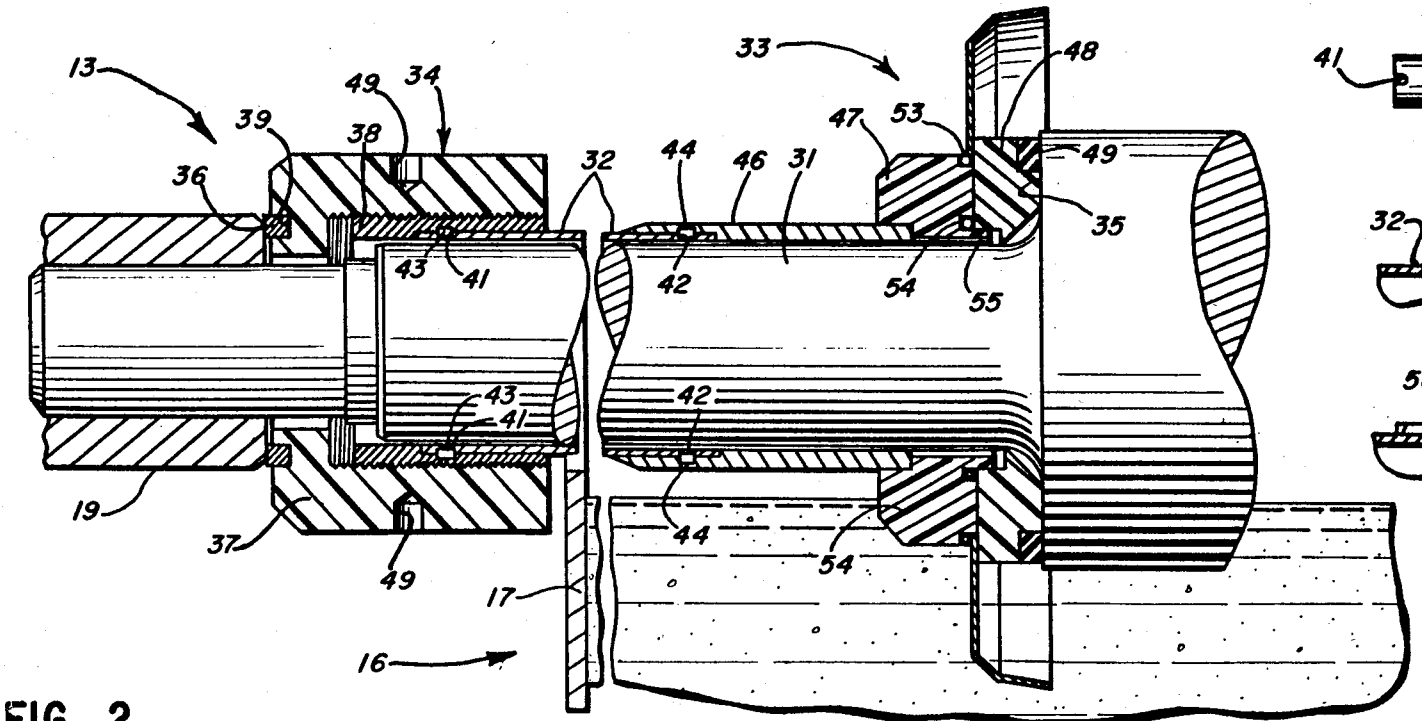
FIG. 2 is a sectional view, on an enlarged scale, taken substantially along line II—II of FIG. 1 and illustrating details of construction of one of the protective devices of the invention.

FIG. 2 illustrates the construction of the device 13 which is mounted on a shaft 31 at one end of the cylinder 12. It will be understood that the device 14 may have substantially the same construction and it is mounted on a shaft like the shaft 31, but at the opposite end of cylinder 12. The illustrated device 13 comprises a sleeve section 32 disposed between a cylinder hub section 33 and an engagement section 34. The cylinder hub section 33 is engaged with an end surface 35 of the cylinder 12. The engagement section 34 is engaged with the hub unit 19. Each of the three sections is of a corrosion resistant material and together they cooperate to provide a protective sealed enclosure for the shaft 31. In the illustrated construction, the section 34 engages the hub unit 19 to allow the section 33 to be sealingly pressed against the ends of the cylinder 12. As shown, a thrust bearing or wear ring 36 is provided at an interface between the section 34 and the hub unit 19.

An important feature relates to the provision of means for adjusting the axial length of at least one of the protective devices to obtain reliable seals. As shown, the section 34 of the device 13 includes an internally threaded nut member 37 which is threaded onto an externally threaded ring 38 at the outer end of the sleeve section 32, nut member 37 being rotatable to adjust the axial length of the device 13 and to press section 33 against the cylinder end surface 35 while pressing ring 36 against the hub unit 19. Ring 36 is disposed in an annular groove 39 in the outer end face of the nut member 37 and is preferably a metal ring operative as a thrust bearing and wear member, nut member 37 being preferably of an insulating material such as PVC.

Figure 3:
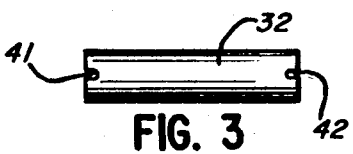
FIG. 3 is a plan view of a tubular member of one of the protective devices, on the same scale as in FIG. 1.

The sleeve section 32 is in the form of a tubular member which is preferably of stainless steel and which has a pair of diametrically opposed notches 41 at one end thereof and another pair of notches 42 at the opposite end thereof, as shown in FIG. 3. To prevent relative rotation of ring 38 and section 33, notches 41 and 42, respectively, interlock with elements 43 on the inside of ring 38 and with elements 44 on the inside of a sleeve 46 which is secured in a central opening of a pressure plate 46 of the cylinder hub section 33. To limit relative axial movement, the inner and outer ends of the member 32 are respectively engaged with internal counterbored shoulders of ring 38 and sleeve 46. Elements 43 and 44 are preferably externally threaded screw elements of very short axial length, screwed into openings in the walls of ring 38 and sleeve 46. Pressure plate 47 is frictionally engaged with a sealing member 48 which, in turn, is frictionally and sealingly engaged with the surface 35, a seal ring 49 of elastomeric material being provided between member 48 and surface 35.

To adjust the axial length an operator uses one hand to hold the tubular member 32 and/or the cylinder hub section 33 against rotation while using the other hand to rotate the nut member 37. As aforementioned, the wear ring 36 is of an anti-friction material to facilitate such rotation. No tools are ordinarily required, but opposed holes 49 are provided in the outside of the nut member 37 for engagement by a suitable tool if ever necessary for disassembly of the device 13.

In accordance with another feature, a shield 51 is supported by the device 13 at one end of the cylinder 12 and a second shield 52 is supported by the device 14 at the opposite end of the cylinder 12. Shields 51 and 52 are constructed and operate to obtain a plating deposit of uniform thickness and to obtain other advantages as disclosed in our aforesaid copending application, the disclosure of which is incorporated herein by reference. The illustrated construction of the cylinder hub section 33 is highly advantageous in obtaining accurate and reliable support. In assembly, the inner portion of the dish-shaped shield 51 is positioned between the plate 47 and the member 48 and in engagement with a seal ring 53. As shown, a second seal ring 54 is provided between plate 47 and member 48, inside the shield 51, and the pressure plate 45 has a reduced-diameter portion 55 which extends within a counter-bored portion of the member 48 to provide a centering function.

Figure 4:
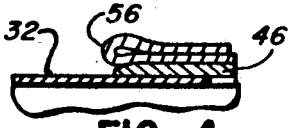
FIG. 4 shows a sealing collar in a retracted position.
Figure 5:
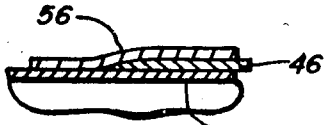
FIG. 5 shows the sealing collar of FIG. 4 in an operative position.

With the construction shown in FIGS. 1 and 2, a highly reliable seal is obtained without any additional seal elements. However, as a precautionary measure, a short strip of tape may be applied around the junction between the end of sleeve 46 and the tubular member 32. In the alternative, a collar 56 of a corrosion resistant resilient material may be disposed around the end of a sleeve 46 to be movable between a folded retracted position as shown in FIG. 4 and an unfolded sealing position as shown in FIG. 5, covering the junction between sleeve 46 and member 32.

Preferably, the tubular member 32 and the sleeve 46 are both of stainless steel but they are electrically insulated from the shaft 31. There is a spacing between the inner surface of member 32 and the shaft 31 and with the nut member 37, pressure plate 47 and seal member 48 being of an electrically insulating material, the member 32 and sleeve 46 are both electrically insulated from the shaft.

Protective devices are thus provided which have a number of important advantages. The component parts of each device can be assembled as a unit, installed as a single assembly and can also be readily disassembled. They provide total corrosion resistance to chemicals used in preparation and plating. They allow use of existing components without modification. They can be readily sealed by hand, no wrench being required. They provide total electrical insulation, and they are rugged and reliable while being constructed from components and materials which are readily available and being otherwise economically manufacturable.

It will be understood that modifications and variations may be effected without departing from the spirit and scope of the novel concepts of this invention.

We claim:

1. Protective apparatus for use with an electroplating assemblage which includes a printing cylinder having a cylindrical surface to be plated and having a pair of shafts projecting axially from opposite ends thereof, a plating tank having a pair of opposed side walls, support means including a pair of support hub units on the outside of said walls and journalled for rotation about a horizontal axis, said hub units being arranged for connection to the ends of said shafts to support said cylinder for rotation about said axis, drive means associated with said support means for rotating said cylinder, and slip ring means associated with said support means for electrically connecting said cylinder to one terminal of a plating current source during rotation of said cylinder, said protective apparatus comprising a pair of protective devices arranged to be assembled on the outside of said shafts between the ends of said cylinder and said support hub units prior to a plating operation and to be removed after a plating operation for subsequent re-use, each of said protective devices comprising: a cylinder hub section disposed around the associated shaft and against an end of said cylinder, an engagement section disposed around the associated shaft and adjacent one of said support hub units, and a sleeve section around the associated shaft between said cylinder hub section and said engagement section, at least one of said protective devices including manual adjustment means for adjusting the effective axial length of said device during assembly and to exert an axial sealing force between said cylinder hub section and said end of said cylinder, each of said sections being of a corrosion resistant material and having an outer surface electrically insulated from the associated shaft, said sections being cooperative upon assembly to provide a protective sealed and insulated enclosure for the associated shaft to prevent contact between the shaft and the plating bath.

2. In protective apparatus as defined in claim 1, said cylinder hub section being of an electrically insulating material.

3. In protective apparatus as defined in claim 2, said sleeve section including a tubular member of stainless steel supported by said cylinder hub section in surrounding relation to said shaft and in spaced non-contacting relation thereto to be electrically insulated therefrom.

4. In protective apparatus as defined in claim 1, said manual adjustment means of said one of said protective devices including means providing a threaded connection between two of said sections for adjusting the axial length of said device upon relative manual rotation of said section and to exert said axial sealing force between said cylinder hub section and said end of said cylinder.

5. In protective apparatus as defined in claim 4, said engagement means of said one of said protective devices including an internally threaded nut member, and externally threaded ring means within said nut member and threadingly engaged therewith at the outer end of said sleeve section.

6. In protective apparatus as defined in claim 5, said sleeve section including a tubular member, and said ring means including a ring member separate from said tubular member, and means providing a connection between said ring member and said tubular member to prevent relative rotation thereof.

7. In protective apparatus as defined in claim 1, said sleeve section including a tubular member of a selected one of a plurality of lengths and separate from said cylinder hub section and said engagement section for assembly therewith and disassembly therefrom to accommodate shafts of various lengths.

8. In protective apparatus as defined in claim 7, said engagement means of at least one of said protective devices including an internally threaded nut member, externally threaded ring means within said nut member and threadingly engaged therewith at the outer end of said sleeve section, and means providing connections between said tubular member and said ring means and said cylinder hub section to prevent relative rotation of said ring means relative to said cylinder hub section.

9. In protective apparatus as defined in claim 7, said cylinder hub section including a sleeve member telescopingly engageable with said tubular member.

10. In protective apparatus as defined in claim 5, bearing means between said nut member and said support hub unit.

11. In protective apparatus as defined in claim 10, said nut member being of a plastic material having an annular groove in the outer surface thereof, and said bearing means comprising a metal wear ring in said annular groove.

12. In protective apparatus as defined in claim 1, said cylinder hub section comprising a pressure plate, a seal member between said pressure plate member and the end of said cylinder, and seal means between said pressure plate and said seal member.

13. In protective apparatus as defined in claim 12, a cup-shaped shield member having an inner portion clamped between said pressure plate and said seal member to be accurately positioned in relation to the end of said cylinder.

14. In protective apparatus as defined in claim 12, a sleeve of stainless steel having an inner end secured within said pressure plate, said sleeve section including a tubular member of stainless steel having an inner end telescopingly engaged with said sleeve.

15. In protective apparatus as defined in claim 14, said pressure plate being of an electrically insulating material and being operative to position said sleeve and said tubular member in spaced non-contacting relation to said shaft.

16. In apparatus as defined in claim 14, a collar of elastomeric material operable to an operative position in surrounding sealing relation to the outwardly facing junction between said sleeve and said tubular member.

* * * * *